US008985892B1

(12) United States Patent
Hunter

(10) Patent No.: US 8,985,892 B1
(45) Date of Patent: Mar. 24, 2015

(54) METHODS OF CONSTRUCTING A PUMP ISLAND PROTECTOR, AND A PUMP ISLAND PROTECTOR FORMED BY SUCH METHODS

(71) Applicant: Peter R Hunter, Alpena, MI (US)

(72) Inventor: Peter R Hunter, Alpena, MI (US)

( * ) Notice: Subject to any disclaimer, the term of this patent is extended or adjusted under 35 U.S.C. 154(b) by 0 days.

(21) Appl. No.: 14/546,137

(22) Filed: Nov. 18, 2014

Related U.S. Application Data

(63) Continuation-in-part of application No. 14/019,578, filed on Sep. 6, 2013.

(51) Int. Cl.

| | |
|---|---|
| ***E01F 15/00*** | (2006.01) |
| ***E01F 1/00*** | (2006.01) |
| ***E01F 15/14*** | (2006.01) |
| *E01C 11/22* | (2006.01) |

(52) U.S. Cl.
CPC . *E01F 1/00* (2013.01); *E01F 15/14* (2013.01); *E01C 11/22* (2013.01)
USPC ..... 404/8; 404/7; 404/72; 404/75

(58) Field of Classification Search
CPC ..... E01C 11/22; E01F 1/00
USPC ..... 404/7, 8, 71, 72, 75
See application file for complete search history.

(56) References Cited

U.S. PATENT DOCUMENTS

| | | | | |
|---|---|---|---|---|
| 2,294,855 | A * | 9/1942 | Thomason | 248/544 |
| 2,298,378 | A * | 10/1942 | Hodges | 362/152 |
| 6,409,422 | B1 * | 6/2002 | Mittermaier et al. | 404/8 |
| 6,712,546 | B1 * | 3/2004 | Radu et al. | 404/8 |
| 6,939,078 | B1 * | 9/2005 | Anderson et al. | 404/73 |
| 7,950,872 | B2 * | 5/2011 | Radu, Jr. | 404/7 |

* cited by examiner

*Primary Examiner* — Raymond W Addie
(74) *Attorney, Agent, or Firm* — Weiner & Burt P.C.; Irvina M. Weiner; Pamela S. Burt

(57) ABSTRACT

A method of constructing a pump island protector to alleviate continuous maintenance required for a deteriorating existing steel pump island base, and a pump island protector constructed by the method. Using an adjustable form system and the combination of stainless steel members and new concrete, the existing pump island is re-wrapped with the stainless steel member and the new concrete.

18 Claims, 10 Drawing Sheets

METHODS OF CONSTRUCTING A PUMP ISLAND PROTECTOR, AND A PUMP ISLAND PROTECTOR FORMED BY SUCH METHODS

The present patent application claims priority from and is a continuation-in-part of pending U.S. patent application Ser. No. 14/019,578 filed Sep. 6, 2013.

BACKGROUND OF THE INVENTION

The present invention relates generally to a method of constructing a pump island protector to alleviate continuous maintenance required for a deteriorating existing steel pump island base, and a pump island protector constructed by such a method.

It is a desideratum of the present invention to avoid the animadversions of conventional techniques for dealing with deterioration of existing pump island bases and/or higher portions disposed on such bases.

BRIEF SUMMARY OF THE INVENTION

The present invention provides a method of constructing a pump island protector to alleviate continuous maintenance required for a deteriorating existing steel pump island base, comprising the steps of: making a saw-cut in pavement around an existing pump island; placing expansion material around an existing dispenser and columns on the existing pump island; cutting off bollards on or near the existing pump island; drilling a plurality of holes in the existing pump island; placing re-rod in said holes to protrude from said holes; placing adjustable forms around the existing pump island; anchoring said adjustable forms to the pavement around the existing pump island; placing stainless steel components into said saw-cut around the existing pump island; placing stainless steel components at a new bollard location for the pump island; anchoring forms to said stainless steel components; applying a bonding agent to existing concrete of the pump island; pouring 4,000 psi new concrete level with a top surface of said stainless steel components and said expansion material to form a cap over the extire pump island; finishing said new concrete; and removing said adjustable forms to provide the completed pump island protector.

The present invention provides a pump island protector constructed in according to the method described above.

The object of the present invention is to provide a method as described hereinabove wherein the saw-cut is made approximately 2 to 4 inches away from the existing pump island, and at a depth of approximately 1 to 1½ inches.

Another object of the present invention is to provide a method as described hereinabove including placing the re-rod in the holes to protrude approximately 2 to 3 inches from the holes.

Another object of the present invention is to provide a method as described hereinabove wherein the stainless steel components are 20 gauge stainless steel.

Another object of the present invention is to provide a method as described hereinabove including pouring 4,000 psi concrete and a 1½-2 inch cap over the entire island and filling the new bollard location, making the concrete level with a top surface of the expansion material.

Other objects, advantages, features and modifications of the present invention will become more apparent to those persons skilled in this particular area of technology and to other persons after having been exposed to the present patent specification with its accompanying drawings.

DETAILED DESCRIPTION OF THE INVENTION

Figure 1:
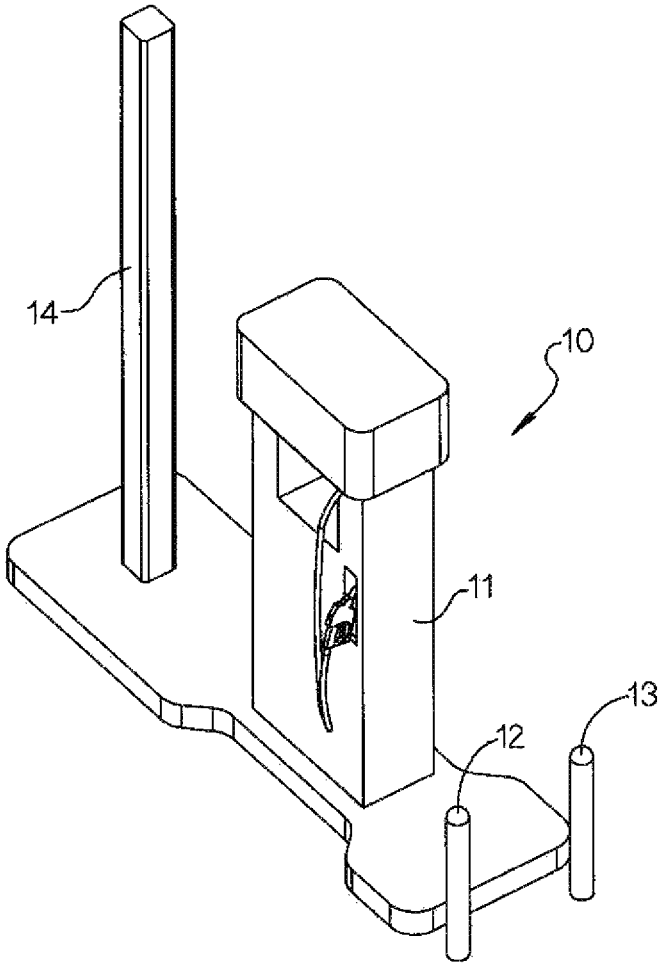
FIG. 1 shows a typical conventional pump island.

With reference to FIG. 1, there is shown a typical conventional pump island 10 with a fuel dispenser 11, bollards 12 and 13, and a canopy support column 14.

FIGS. 2 through 10 illustrate the steps of the method by which the pump island protector 30 is constructed.

Figure 2:
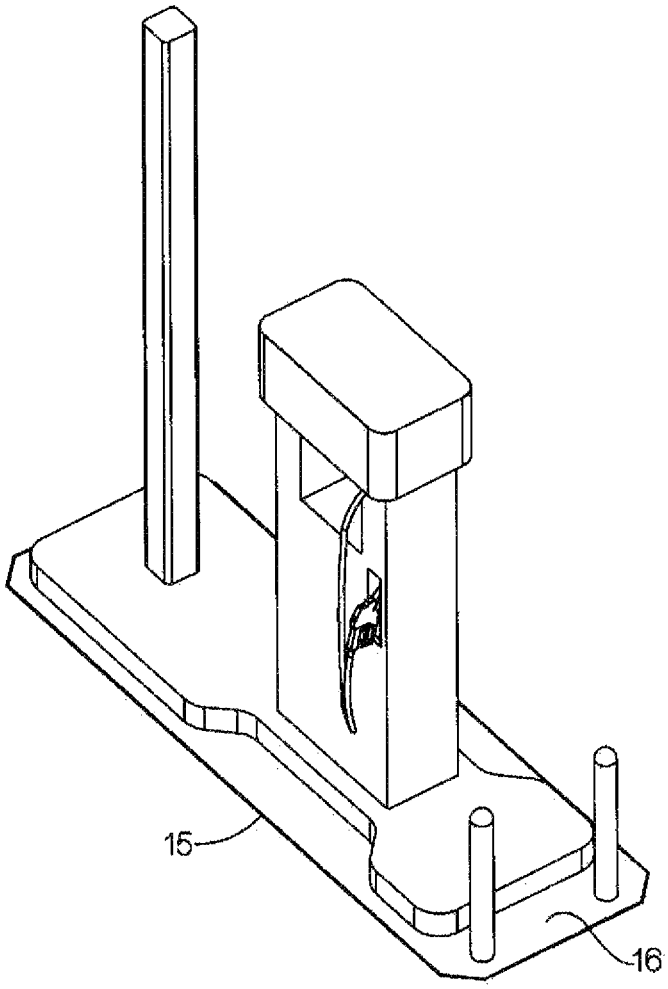
FIG. 2 shows the FIG. 1 pump island with a saw-cut in the pavement around the pump island.

FIG. 2 shows the saw-cut 15 made in the pavement 16 around the pump island 10.

The saw-cut 15 is offset 2 to 4 inches away from the existing pump island 10.

The saw-cut 15 is cut 1 to 1¼ inches deep.

Figure 3:
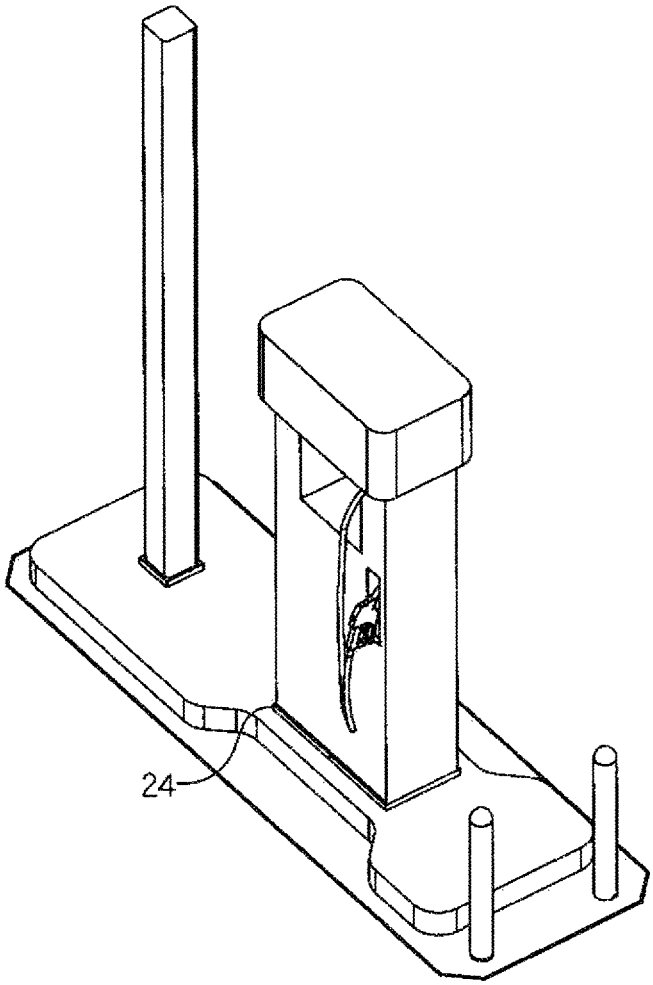
FIG. 3 shows the FIG. 2 pump island with expansion material in place.

With reference to FIG. 3, expansion material 16 is placed around the existing pump dispenser 11, and any column 14, to allow for future removal or service. This gives the option to pull the pump dispenser 11 if necessary in the future.

Figure 4:
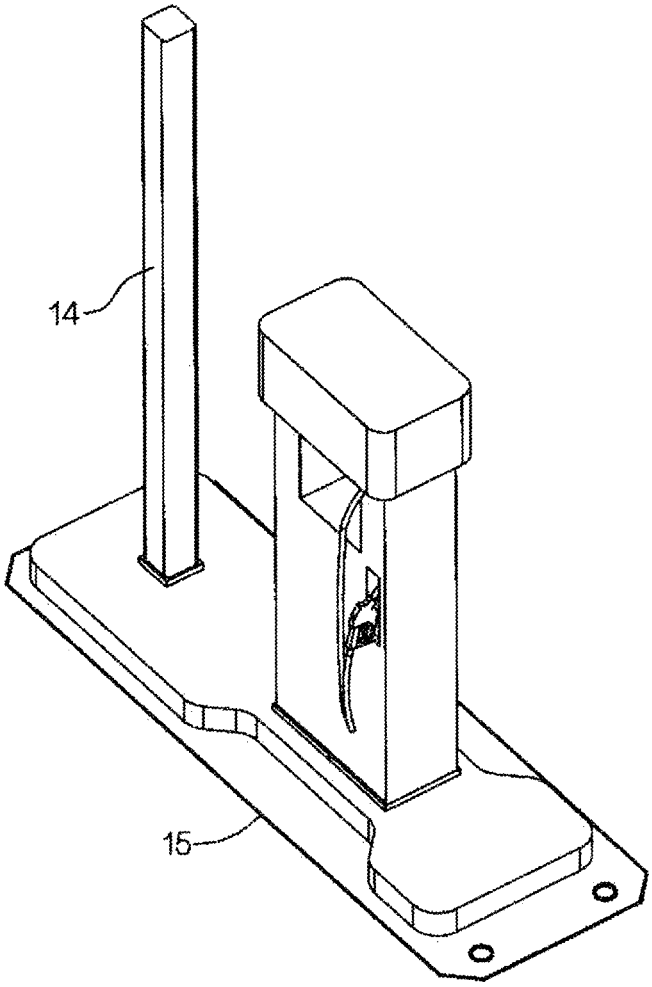
FIG. 4 shows the FIG. 3 pump island with the existing bollards cut off.

FIG. 4 illustrates cutting off the existing bollards 12 and 13.

Figure 5:
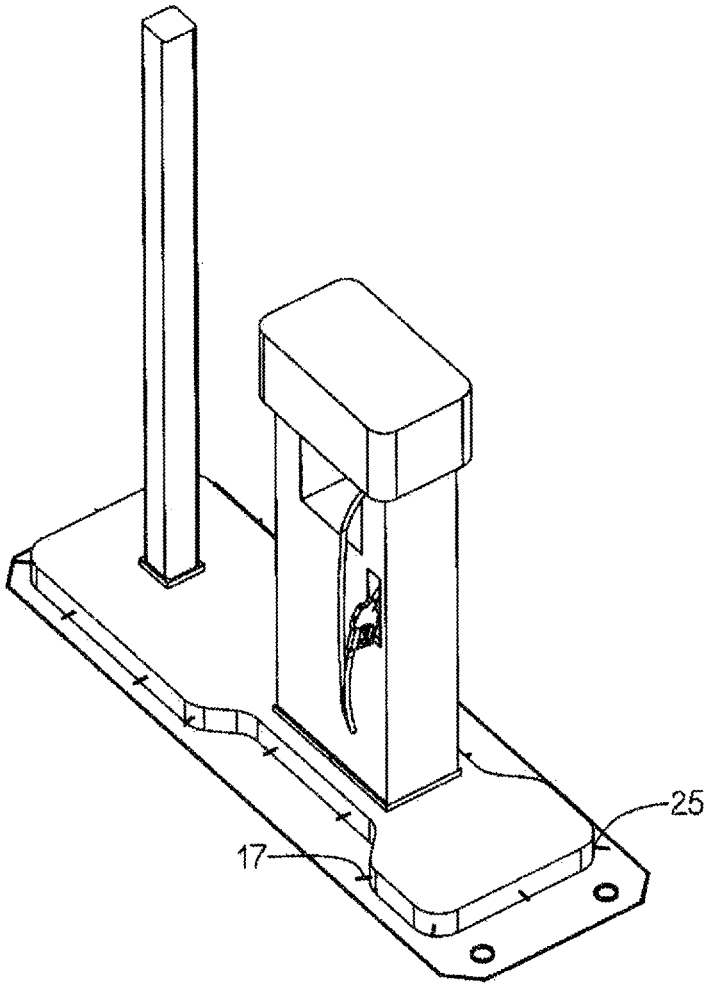
FIG. 5 shows the FIG. 4 pump island with re-rods protruding therefrom.

With reference to FIG. 5, holes 16 are drilled in the existing pump island 10, and then re-rods 17 are placed in the holes 16.

The re-rods 17 protrude 2 to 3 inches from the pump island.

FIG. 5 illustrates placing the adjustable forms and anchoring them to the pavement or existing concrete around the pump island 10.

Figure 6:
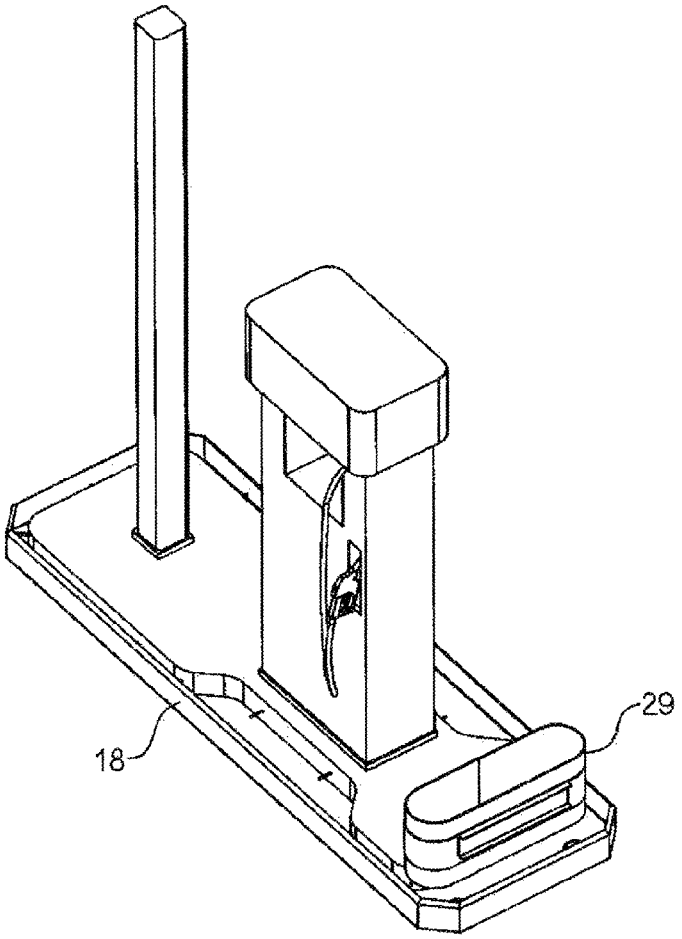
FIG. 6 shows the FIG. 5 pump island with stainless steel placed in the saw-cut and at a new bollard location.

FIG. 6 illustrates placement of stainless steel members 18 into the saw-cut 15 around the island 10 and at a new bollard location 19.

The bollard form 20 is set on top of an end of the existing pump island 10, and lined with stainless steel members 18.

The stainless steel 18 is 20-gauge stainless steel.

Figure 7:
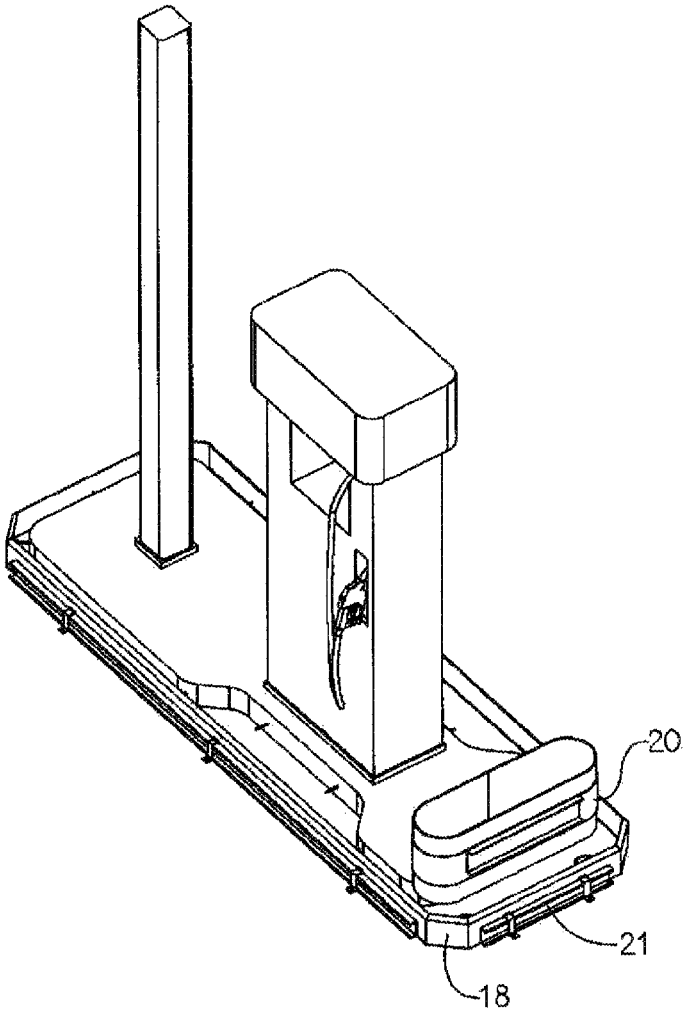
FIG. 7 shows the FIG. 6 pump island with adjustable forms anchored to the stainless steel.

FIG. 7 shows the adjustable forms 21 anchored to the stainless steel members 18.

The adjustable forms 21 are also anchored to the pavement or existing concrete around the pump island 10.

Figure 8:
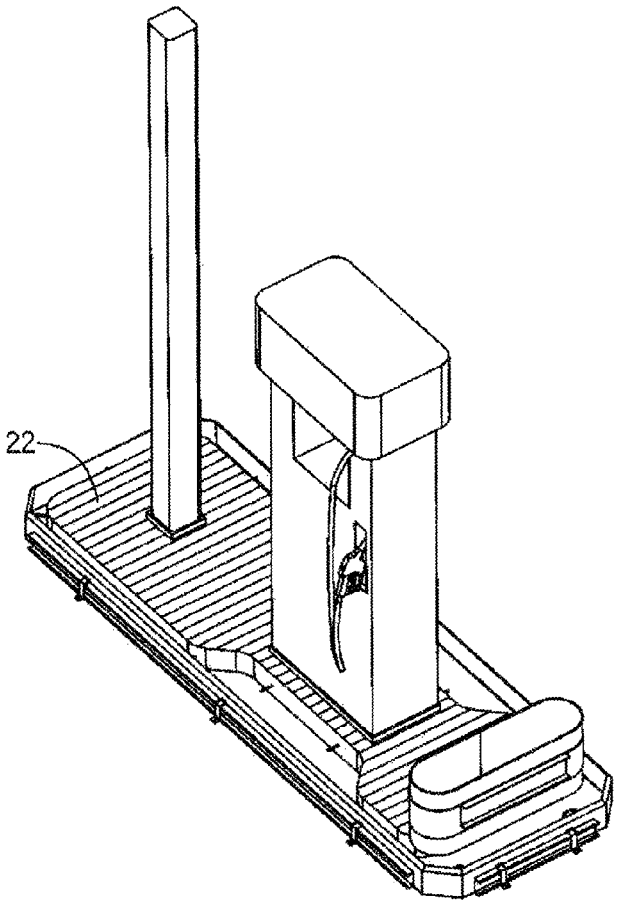
FIG. 8 shows the FIG. 7 pump island with a bonding agent applied to the existing concrete.

FIG. 8 shows the bonding agent 22 spread or applied to the existing concrete.

Figure 9:
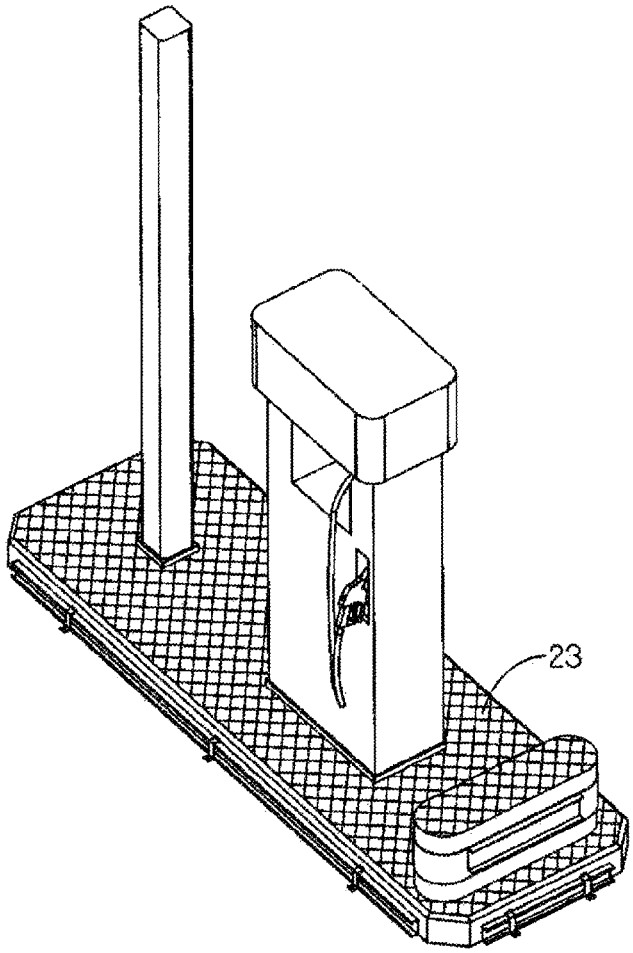
FIG. 9 shows the FIG. 8 pump island with 4,000 psi concrete placed thereon.

FIG. 9 shows the placement of 4,000 psi concrete level with the top of the stainless steel members 18 and expansion material 24 to form a 1½-2 inch cap over the entire pump island.

The 4,000 pound concrete 23 is poured and a 1½-2 inch cap over the entire island and fill the bollard.

The concrete 23 is made level with the top of the expansion material 24.

The concrete 23 is then finished.

Figure 10:
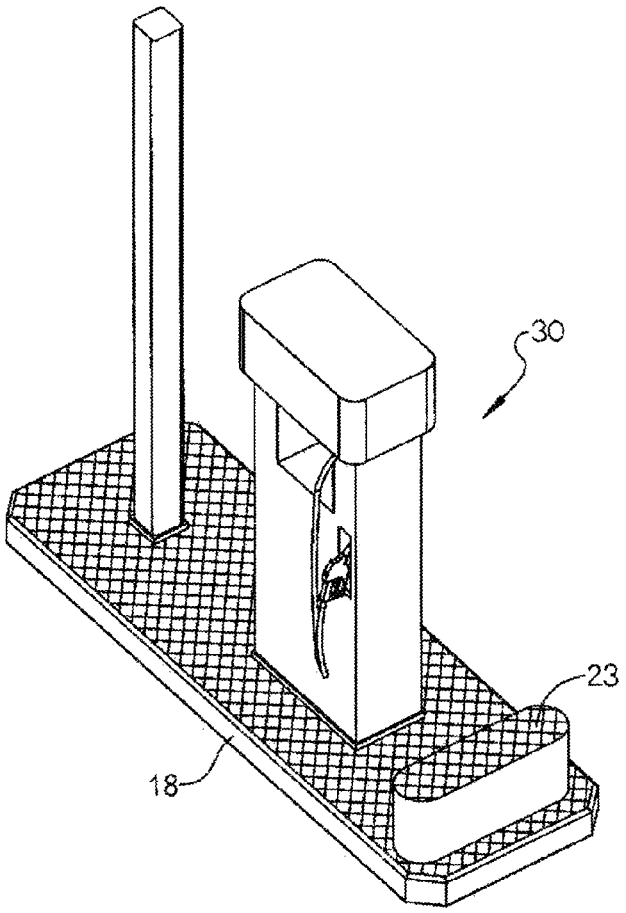
FIG. 10 shows the FIG. 9 pump island with the adjustable forms removed therefrom.

FIG. 10 shows the new pump island 30 with the adjustable forms 21 removed therefrom.

The invention thus provides a method of constructing a pump island protector 30 to alleviate continuous maintenance required for a deteriorating existing steel pump island base, comprising the steps of:

making a saw-cut in pavement around an existing pump island;

placing expansion material around the existing pump and columns of the existing pump island;

cutting off bollards on or near the existing pump island;

drilling a plurality of holes in the existing pump island;

placing re-rod in said holes to protrude from said holes;

placing adjustable forms around the existing pump island;

anchoring said adjustable forms to the pavement around the existing pump island;

placing stainless steel components into said saw-cut around the existing pump island;

placing stainless steel components at a new bollard location for the pump island;

anchoring forms to said stainless steel components;

applying a bonding agent to existing concrete of the pump island;

pouring 4,000 psi new concrete level with a top surface of said stainless steel components and said expansion material to form a cap over the extire pump island;

finishing said new concrete; and removing said adjustable forms to provide the completed pump island protector.

The invention also provides a pump island protector produced according to the above-described method.

While the foregoing describes only exemplary embodiments of the present invention, it is to be understood that the present invention covers all variations, modifications and changes thereof which will occur to those persons skilled in the art and to other persons after having been exposed to the present patent application.

There have described hereinabove only one possible unique and novel embodiment of the present invention which can be practiced and constructed in many different embodiments, configurations, materials, arrangements of components, sizes, and shapes.

It should be understood that many changes, modifications, variations, and other uses and applications will become apparent to those persons skilled in this particular area of technology and to others after having been exposed to the present patent specification.

Any and all such changes, modifications, variations and other uses and applications which do not depart from the spirit and scope of the present invention are therefore covered by and embraced within the present invention and the patent claims set forth hereinbelow.

The invention claimed is:

1. A method of constructing a pump island protector to alleviate continuous maintenance required for a deteriorating existing steel pump island base, comprising the steps of:

making a saw-cut in pavement around an existing pump island;

placing expansion material around an existing dispenser and columns on the existing pump island;

cutting off bollards on or near the existing pump island;

drilling a plurality of holes in the existing pump island;

placing re-rod in said holes to protrude from said holes;

placing adjustable forms around the existing pump island;

anchoring said adjustable forms to the pavement around the existing pump island;

placing stainless steel components into said saw-cut around the existing pump island;

placing stainless steel components at a new bollard location for the pump island;

anchoring forms to said stainless steel components;

applying a bonding agent to existing concrete of the pump island;

pouring 4,000 psi new concrete level with a top surface of said stainless steel components and said expansion material to form a cap over the extire pump island;

finishing said new concrete; and removing said adjustable forms to provide the completed pump island protector.

2. The method according to claim 1, wherein:

making said saw-cut approximately 2 to 4 inches away from the existing pump island, at a depth of approximately 1 to 1½ inches.

3. The method according to claim 1, wherein:

placing said re-rod in said holes to protrude approximately 2 to 3 inches from said holes.

4. The method according to claim 2, wherein:

placing said re-rod in said holes to protrude approximately 2 to 3 inches from said holes.

5. The method according to claim 1, wherein:

said stainless steel components are 20 gauge stainless steel.

6. The method according to claim 2, wherein:

said stainless steel components are 20 gauge stainless steel.

7. The method according to claim 3, wherein:

said stainless steel components are 20 gauge stainless steel.

8. The method according to claim 4, wherein:

said stainless steel components are 20 gauge stainless steel.

9. The method according to claim 1, wherein:

pouring 4,000 psi concrete and a 1½-2 inch cap over the entire island and filling said new bollard location, making the concrete level with a top surface of said expansion material.

10. The method according to claim 2, wherein:

pouring 4,000 psi concrete and a 1½-2 inch cap over the entire island and filling said new bollard location, making the concrete level with a top surface of said expansion material.

11. The method according to claim 3, wherein:

pouring 4,000 psi concrete and a 1½-2 inch cap over the entire island and filling said new bollard location, making the concrete level with a top surface of said expansion material.

12. The method according to claim 4, wherein:

pouring 4,000 psi concrete and a 1½-2 inch cap over the entire island and filling said new bollard location, making the concrete level with a top surface of said expansion material.

13. The method according to claim 5, wherein:

pouring 4,000 psi concrete and a 1½-2 inch cap over the entire island and filling said new bollard location, making the concrete level with a top surface of said expansion material.

14. The method according to claim 6, wherein:

pouring 4,000 psi concrete and a 1½-2 inch cap over the entire island and filling said new bollard location, making the concrete level with a top surface of said expansion material.

15. The method according to claim 7, wherein:

pouring 4,000 psi concrete and a 1½-2 inch cap over the entire island and filling said new bollard location, making the concrete level with a top surface of said expansion material.

16. A pump island protector produced according to the method of claim 1.

17. The method according to claim 8, wherein:

pouring 4,000 psi concrete and a 1½-2 inch cap over the entire island and filling said new bollard location, making the concrete level with a top surface of said expansion material.

18. A pump island protector produced according to the method of claim 17.

* * * * *